US005853565A

United States Patent [19]

Cayton

[11] Patent Number: 5,853,565

[45] Date of Patent: Dec. 29, 1998

[54] CONTROLLING THERMAL COKING

[75] Inventor: Roger Cayton, Naperville, Ill.

[73] Assignee: Amoco Corporation, Chicago, Ill.

[21] Appl. No.: 625,935

[22] Filed: Apr. 1, 1996

[51] Int. Cl.[6] ..... C10G 9/16

[52] U.S. Cl. ..... 208/48 AA; 208/61; 208/131; 208/132; 585/950

[58] Field of Search ..... 208/48 AA, 131, 208/132, 61; 585/950

[56] References Cited

U.S. PATENT DOCUMENTS

| | | | |
|---|---|---|---|
| 2,963,416 | 12/1960 | Ward et al. | 208/61 |
| 3,105,810 | 10/1963 | Miller et al. | 208/48 AA |
| 3,112,181 | 11/1963 | Petersen et al. | 23/209.1 |
| 3,531,394 | 9/1970 | Koszman | 208/48 AA |
| 3,554,914 | 1/1971 | Nagy | 252/75 |
| 3,769,200 | 10/1973 | Folkins | 208/53 |
| 3,773,653 | 11/1973 | Nongbri et al. | 208/58 |
| 3,958,624 | 5/1976 | Peeler et al. | 208/48 AA |
| 4,235,703 | 11/1980 | Kegler et al. | 208/131 |
| 4,324,648 | 4/1982 | Roberts et al. | 208/114 |
| 4,337,144 | 6/1982 | Yoo | 208/120 |
| 4,399,024 | 8/1983 | Fukui et al. | 208/131 |
| 4,404,087 | 9/1983 | Reed et al. | 208/48 AA |
| 4,545,893 | 10/1985 | Porter et al. | 208/48 |
| 4,551,227 | 11/1985 | Porter et al. | 208/48 AA |
| 4,585,545 | 4/1986 | Yancey, Jr. et al. | 208/74 |
| 4,595,772 | 6/1986 | Blaschke et al. | 556/77 |
| 4,601,815 | 7/1986 | Forester et al. | 208/120 |
| 4,704,375 | 11/1987 | Martinez et al. | 208/120 |
| 4,804,487 | 2/1989 | Reed et al. | 208/48 AA |
| 4,818,368 | 4/1989 | Kalnes et al. | 208/50 |
| 4,889,614 | 12/1989 | Forester | 208/48 AA |
| 4,964,979 | 10/1990 | Krishna et al. | 208/253 |
| 5,019,241 | 5/1991 | Forester | 208/120 |
| 5,160,602 | 11/1992 | Becraft et al. | 208/131 |
| 5,284,994 | 2/1994 | Brown et al. | 208/48 AA |
| 5,319,119 | 6/1994 | Kaneshima et al. | 556/14 |
| 5,401,384 | 3/1995 | Martinez et al. | 208/52 |
| 5,424,262 | 6/1995 | de Lasa et al. | 502/64 |
| 5,435,904 | 7/1995 | Reed et al. | 208/48 AA |

OTHER PUBLICATIONS

Excerpt from *Petroleum Refinery Engineering*, 4th Edition, by: W. L. Nelson, pp. 686–693 re: Thermal Cracking and Decomposition Process, (No Date).

*Primary Examiner*—Walter D. Griffin
*Attorney, Agent, or Firm*—Robert A. Yesukevich; Frank J. Sroka

[57] ABSTRACT

The invention provides a method for controlling the relative proportion of products produced from a petroleum residuum by thermal coking. Coke yield promoting compounds are identified, and effective attenuating agents are specified. The method can mitigate a coke promoting effect induced by certain surfactants, antifoulants, or fugitive catalysts in thermal coking units. Mitigating the coke yield promoting effect of molybdenum, for example, in a thermal coker permits recovery of a greater proportion of distillate boiling range products.

14 Claims, 4 Drawing Sheets

CONTROLLING THERMAL COKING

BACKGROUND OF THE INVENTION

1. Field of the Invention

The present invention relates to a method for controlling a thermal hydrocarbon conversion reaction in heavy hydrocarbon oils. More specifically, the invention relates to thermal coking of petroleum residua which contain one or more components which promote or suppress coke formation.

2. Description of the Prior Art

In a group of widely practiced petroleum refining processes known generically as thermal coking, coke and a distillate boiling range product are produced from a liquid hydrocarbon charge stock under a relatively low hydrogen partial pressure by a thermal hydrocarbon conversion reaction. The charge stock is not completely vaporized before reacting, as in vapor phase thermal cracking processes. Unlike hydroconversion processes such as hydrocracking and hydrotreating, the thermal coking processes do not rely on an external source of hydrogen.

In contrast to air-blown coking processes, the thermal coking processes require no makeup stream of air or other oxygen-containing gas as a reagent. Catalysts are not traditionally added to or regenerated within the thermal coking processes as in, for example, fluidized bed catalytic cracking processes. The thermal coking processes include delayed coking and fluid coking. Additional information on thermal coking can be found in Nelson's PETROLEUM REFINERY ENGINEERING (4th Edition) at pages 686–693.

In a typical delayed coking unit, preheated charge stock enters a coking drum at a temperature which promotes thermal cracking. Coke is permitted to accumulate as a solid in the drum, while cracked vapors are removed from the drum and fractionated to produce, for example, distillate boiling range products, coker gasoline, and fuel gas. The accumulated coke is eventually cooled and removed from the drum, often after the coke has been comminuted by a drill or a hydraulic lance. U.S. Pat. No. 3,769,200 issued to Folkins describes a typical delayed coking process and is hereby incorporated in its entirety, and especially for its teachings regarding delayed coking.

Fluid coking is a continuous process in which a charge stock is sprayed into a fluidized bed of coke particles which is typically maintained at about 500 degrees C. The charge stock vaporizes and cracks, forming a liquid film on the coke particle surfaces. A portion of the product coke is comminuted and recycled to maintain the coke particles of the bed in a desired size range. Cracked vapors are recovered as, for example, distillate boiling range products, coker gasoline, and fuel gas.

The charge stocks for the delayed coking process or for the fluid coking process are commonly a relatively higher boiling range material termed a petroleum residuum or a resid. The resid often contains hydrocarbon material having a five volume percent atmospheric boiling point of 500 degrees C. or more. The resid may be, for example, a reduced crude separated from crude petroleum by atmospheric or vacuum distillation. Alternatively, the resid may be a relatively heavy product from a refinery hydrconversion process unit such a hydrotreater or hydrocracker or a solvent separation unit such as a propane deasphalter. The resid may include various sulfuric components and metallic components which have been introduced into the resid during the natural course of petroleum formation, such as petroporphyrins. Alternatively, the resid may include metal-containing compounds which have been artificially introduced.

An example of a metallic component introduced artificially into a resid is reported in U.S. Pat. No. 5,319,119 issued to Kaneshima et al. The '119 Patent states that an oleophilic molybdenum compound is a catalyst precursor appropriate for addition to a hydroconversion reaction system producing hydrocarbons of relatively decreased molecular weight, as compared to an associated feedstock. In the reaction system, the molybdenum compound reportedly converts to a catalyst which the '119 Patent describes as a highly dispersed molybdenum sulfide-like compound. The '119 Patent is hereby incorporated in its entirety, and especially for its teachings regarding hydroconversion catalysts.

U.S. Pat. No. 4,399,024 issued to Fukui et al. describes a method for producing cracked oil with a higher yield and coke having a higher fixed carbon content from petroleum heavy oil. The method is reportedly characterized by subjecting a petroleum heavy oil to heat treatment together with at least one additive selected from the group consisting of metal salts of dialkyldithiocarbamic acids, diaryldithiocarbamic acids, alkylxanthogenic acids, arylxanthogenic acids, dialkyldithiophosphoric acid and diaryldithiophosphoric acids, organic esters of phosphoric acid, benzothiazoles and disulfides. The '024 Patent states that metals which are useful for inclusion in such metal salts are zinc, sodium, potassium, nickel, tin, antimony, lead, cadmium, molybdenum, tungsten, chromium, manganese, tellurium, bismuth, selenium and the like.

A process for producing isotropic coke, which is said to be used to manufacture graphite logs which serve as moderators in nuclear reactors, is described in U.S. Pat. No. 5,160,602 issued to Becraft et al. The process reportedly includes combining a mineral oil, which does not usually produce acceptable isotropic coke, with an inorganic additive which promotes pyrolysis and which vaporizes during subsequent calcining, and then subjecting the combination to delayed coking to produce isotropic coke having a low co-efficient of thermal expansion ratio. The '602 Patent states that preferred additives used in the process are elements selected from Groups 4A and 5A of the Periodic Table and sulfides of such elements, including tin, arsenic, phosphorous red, lead, phosphorous sesquisulfide, phosphorous pentasulfide, and arsenic pentasulfide. The '602 Patent reports that the additive is usually combined with the mineral oil in an amount between about 0.1 and about 5.0 weight percent.

Because the difference in economic values of the coke and the distillate boiling range products produced in thermal coking units is often significant and subject to change, the petroleum refining industry has invested much time and effort in identifying methods for predicting and controlling the rate of production of various thermal delayed coker products. Correlations have been produced which relate delayed coker charge stock properties to reaction time, temperature and pressure. However, there still exists a need for an improved method of controlling the relative amount of coke, as compared to the amounts of distillate boiling range products and other products, produced in thermal cracking processes such as delayed coking and fluid coking.

SUMMARY OF THE INVENTION

The present invention is a method for controlling the relative amount of coke produced, as compared to other products, in a thermal coking process from a charge stock which contains one or more identifiable components which promote coke formation. The inventor has found that certain metal-containing compounds act to increase coke production, while the action of the compounds is mitigated by selected attenuating agents. The coke promoting compounds include molybdenum, vanadium, nickel, cobalt or copper. The attenuating agents are substantially composed of one or more of antimony, lead, tin, bismuth, or calcium. The attenuating agent is introduced as a solute or a suspension which converts to a particulate dispersion under thermal coking reaction conditions.

In one aspect, the invention comprises blending a coke residuum which contains a coke promoting compound, other than a porphyrin, and an attenuating agent which includes an attenuating metal to produce a treated residuum which is thermally coked. It has been found that the use of antimony dithiocarbamate, antimony dithiophosphate, lead dithiocarbamate, tin dialkyldicarboxylate, bismuth dithiocarbamate, calcium sulfonate, or a mixture thereof as the attenuating agent permits the recovery of distillate boiling range product from the thermal coking unit in a proportion which is significantly greater than was possible using traditional methods.

In another aspect, the invention comprises hydroprocessing a feedstock containing a hydrocracking catalyst which includes a promoting metal. The hydrocracking catalyst is typically utilized in an ebullated or suspended dispersed bed. A portion of the hydrocracking catalyst escapes from the hydroprocessing reaction zone, and travels as with the hydroprocessed residuum. The fugitive catalyst and the hydroprocessed residuum are treated with an attenuating agent. Thermal coking of the treated residuum leads to recovery of a distillate boiling range product in a relatively greater proportion than would have been posssible using previously known methods.

DETAILED DESCRIPTION OF PREFERRED ASPECTS OF THE INVENTION

Figure 1:
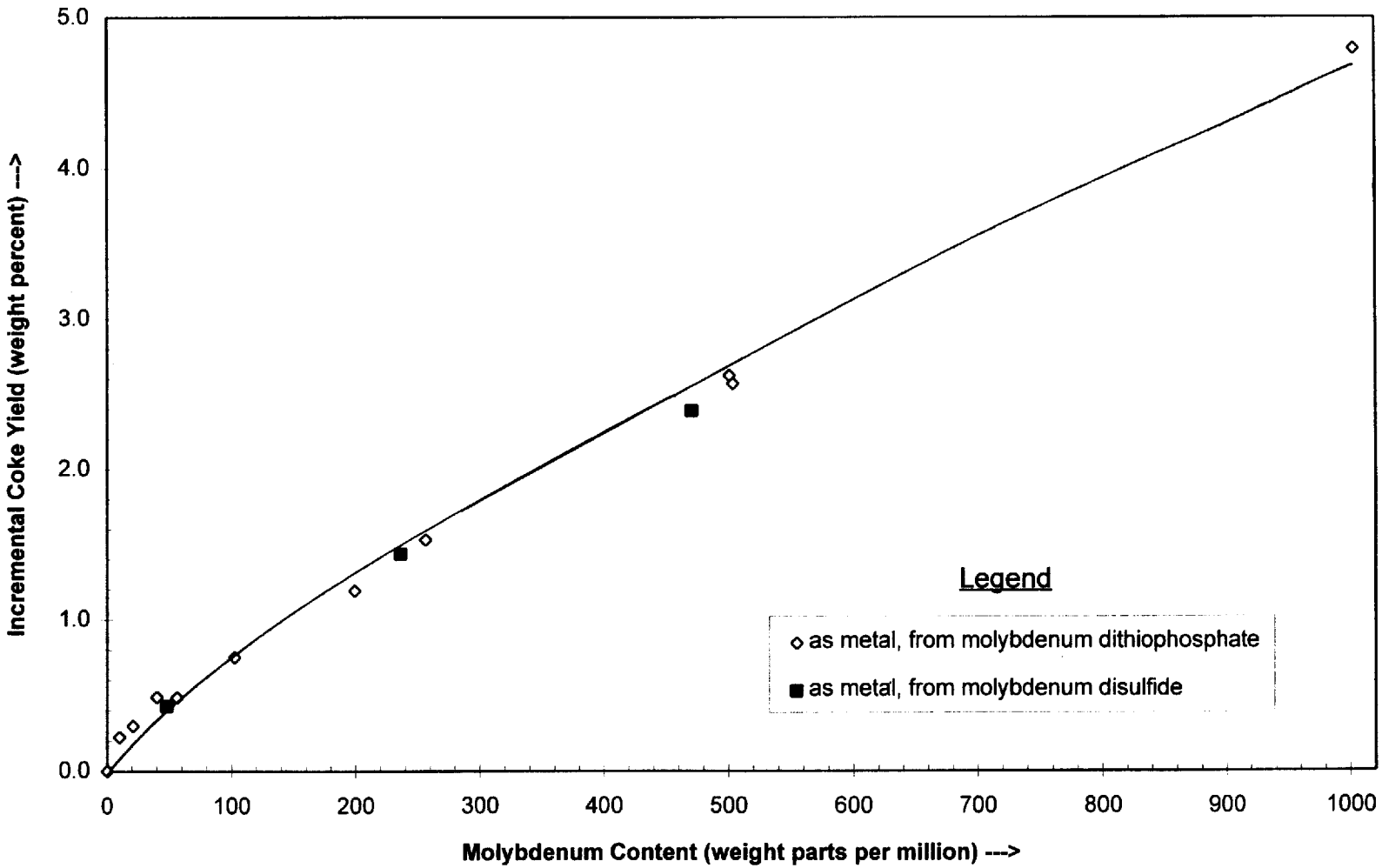
FIG. 1 is a graph depicting an incremental coke yield for a petroleum residuum subjected to a micro-pyrolysis test method as a monotonically increasing function of molybdenum content in the residuum.

In a preferred aspect, the invention is a method for controlling the rate and yield of coke production in a thermal coking process. Although this aspect is now described as it relates to a delayed coking process, it may be effectively applied to other thermal coking processes, such as fluid coking and visbreaking. Similarly, although reference is made to a particular petroleum residuum as feedstock, this aspect may be advantageously applied to any suitable thermal coking feedstock including, but not limited to, atmospheric residuum, vacuum residuum, thermally cracked residuum, catalytically cracked residuum, hydrocracked residuum, solvent deasphalted residuum, tar sand bitumen, and crude shale oil.

This aspect of the invention can mitigate an unwanted increase in coke yield which results from the presence of artificially introduced coke promoting compounds in delayed coker feedstock. While delayed coking is widely understood to be a thermal process, rather than a catalytic process, undesirable contaminants which can effect coke yield occasionally find their way into delayed coker feedstocks. Some of the contaminants promote an increase in coke yield, even when present in relatively small concentrations. The contaminants are also associated with operability problems such as abnormally slow cooling of the delayed coking reaction vessels, and formation of low-grade coke products, often described as shot coke or dense coke.

Such contaminants may be introduced into the delayed coker feedstock by, for example, addition of chemical surfactants, antifoulants, or corrosion inhibitors; recycling of waste streams; or migration of catalytic material from upstream reactors. The contaminants may enter the feedstock as suspended particulate or as solutions of hydrocarbon-soluble organometallic compounds. It is believed that the some of the most pernicious of the contaminants form a dispersion of fine particulate under delayed coking reaction conditions.

This aspect provides a method for mitigating the coke yield enhancement effect of coke promoting compounds, other than porphyrins, which include a promoting metal selected from the group consisting of molybdenum, vanadium, nickel, cobalt, copper or a mixture thereof. These metals are coke promoting in the sense that, when dispersed in a suitable petroleum residuum under thermal coking conditions, the coke promoting metals enhance the production of coke from the residuum as compared to the yield of coke that is produced under identical conditions but without the presence of the coke promoting metal.

Because delayed coking is a widely practiced refinery process, practitioners will appreciate which feedstocks are suitable for delayed coking. However, residua having an overall carbon to hydrogen ratio within certain ranges appear to benefit most from the coke yield attenuating effect of the present invention. Therefore, residua substantially composed of hydrocarbon molecules having a collective hydrogen to carbon molar ratio in the range of about 0.8 to about 1.6. are preferred, and residua having a hydrogen to carbon ration of about 1.0 to about 1.5 are especially preferred.

Additionally, it is preferred that the feedstock contain in the range of about 0.1 to about 10 weight percent sulfur to facilitate precipitation of soluble organometallic compounds so as to form a dispersion of micro-particulate in the delayed coking reaction zone. Also, the total concentration of promoting metals in the feedstock should be sufficient to create an increase in coke yield which is commercially significant, yet not so great as to require a cumbersome amount of the attenuating agents. Therefore, it is preferred that the total concentration of molybdenum, vanadium, nickel, cobalt, and copper in the feedstock is in the range of about 20 to less than about 10,000 parts per million by weight, more preferably about 50 to less than about 5000 parts per million. Chemical analyses for three typical residua which are suitable for use in the present aspect are shown in Table I, below.

TABLE I

| | Residuum A | Residuum B | Residuum C |
|---|---|---|---|
| Carbon (wt %) | 84.4 | 84.5 | 87.09 |
| Hydrogen (wt %) | 9.9 | 10.21 | 9.16 |
| Nitrogen (wt %) | 0.7 | 0.62 | 0.91 |
| Sulfur (wt %) | 6.1 | 4.10 | 1.85 |
| Vanadium (wt ppm) | 540 | 167 | 101 |
| Nickel (wt ppm) | 108 | 40 | 53 |
| Iron (wt ppm) | 20 | 13 | — |
| Carbon:Hydrogen (molar ratio) | 1.40 | 1.44 | 1.25 |

In order to suppress the coke yield enhancement effect of the above described coke promoting compounds, an attenuating agent, other than a porphyrin, which includes an attenuating metal selected from the group consisting of antimony, lead, tin, bismuth, calcium or a mixture thereof is blended with a petroleum residuum which is suspected of containing the coke promoting compound so as to produce a treated residuum. Preferably, about 10 to about 1,000 parts per million by weight of the attenuating agent is blended with the residuum, more preferably about 20 to about 500 parts per million, and most preferably about 50 to about 300 parts per million, based on the weight of the petroleum residuum.

The attenuating agent may be injected directly into a delayed coking reaction zone where feedstock is present. In that case, the treated residuum exists primarily within the reaction zone. Alternatively, the attenuating agent is diluted to an appropriate concentration in an optional carrier liquid, such as material from the refinery stream known as decanted oil, and injected into a delayed coker feedstock which is subsequently passed to a delayed coking reaction zone.

The treated residuum is converted to products including coke and a distillate boiling range product at reaction conditions well known to the petroleum refining industry. Appropriate thermal coking conditions include a hydrogen partial pressure of about 0.01 to about 2 atmospheres, a temperature in the range of about 400 to about 600 degrees C., and a residence time of about one to about forty hours. The distillate product is recovered at a higher yield than would have been possible had the attenuating agent not been blended with the petroleum residuum containing the coke promoting compound.

It is contemplated that the attenuating agent may be converted to a relatively active form in the coking reaction zone upon exposure to thermal coking reaction conditions. Without intending to be bound by theory, the inventor hypothesizes that the composition of the attenuating agent is important primarily as a vehicle for introducing the attenuating metal into a delayed coking reaction zone in highly dispersed form. It is believed that the attenuating metal is dispersed within the reaction zone as colloidal particles composed of metal sulfides.

Any suitable form of antimony may be utilized as the attenuating agent. Elemental antimony, inorganic antimony compounds and organic antimony compounds as well as mixtures of two or more thereof are suitable sources of antimony. The term "antimony" generally refers to any one of these antimony sources.

Examples of some antimony compounds which can be used as attenuating agents include antimony oxides, such as antimony trioxide, antimony tetroxide, and antimony pentoxide; antimony sulfides such as antimony trisulfide and antimony pentasulfide; antimony sulfates such as antimony trisulfate; antimonic acids such as meta antimonic acid, ortho antimonic acid and pyro antimonic acid; antimony halides such as antimony trifluoruide, antimony trichloride, antimony tribromide, antimony triiodide, antimony pentafluoride and antimony pentachloride; and antimonyl halides such as antimonyl chloride and antimonyl trichloride.

Examples of some organic antimony compounds which can be used as attenuating agents include antimony carboxylates such as antimony triformate, antimony triacetate, antimony tridodecanoate, antimony trioctadecanoate, antimony tribenzoate and antimony tris(cyclohexenecarboxylate); antimony thiocarboxylates such as antomony tris (thioacetate), antimony tris(dithioacetate) and antimony tris (dithiopentanoate); antimony thiocarbonates such as antimony tris(O-propyldithiocarbonate); antimony carbonates such as antimony tris(ethyl carbonates); trihydrocarbylantimony compounds such as triphenylantimony; trihydrocarbylantimony oxides such as triphenylantimony oxide; antimony salts of phenolic compounds such as antimony triphenoxide; antimony salts of triphenolic compounds such as antimony tris(thiophenoxide); antimony sulfonates such as antimony tris(benzenesulfonate) and antimony tris(p-toluenesulfonate); antimony carbamates such as antimony tris(diethylcarbamate); antimony thiocarbamates such as antimony tris(dipropyldithiocarbamate), antimony tris (phenyldithiocarbamate), antimony tris (butylthiocarbamate); antimony phosphites such as antimony tris(diphenyl phosphite); antimony phosphates such as antimony tris)dipropyl phosphate; antimony thiophosphates such as antimony tris(O,O-dipropyl dithiophosphate) and antimony tris(O,O-dipropyl dithiophosphate).

Of the above mentioned attenuating agents which include antimony, those which are organometallic and soluble in petroleum residua are preferred. Antimony dithiocarbamate and antimony dithiosphate are especially preferred. Attenuating agents including antimony are preferred for use in residua containing a promoting compound which includes molybdenum or nickel.

Any suitable form of tin may be utilized as the attenuating agent, alone or in combination with other attenuating agents. Elemental tin, inorganic tin compounds, and organic tin compounds may be employed. The term "tin" refers to any of these sources.

Examples of some inorganic tin compounds which are suitable for use as the attenuating agent include tin oxides such as stannous oxide and stannic oxide; tin sulfides such as stannous sulfide and stannic sulfide; tin sulfates such as stannous sulfate and stannic sulfate; stannic acids such as meta stannic acid and thio stannic acid; tin halides such as stannous fluoride, stannous chloride, stannous bromide, stannous iodide, stannic fluoride, stannic chloride, stannic bromide, and stannic iodide; tin phosphates such as stannic phosphate, and tin oxyhalides such as stannous oxychloride and stannic oxychloride.

Examples of some organic tin compounds which can satisfactorily be utilized as the attenuating agent include tin carboxylates such as stannous formate, stannous acetate, stannous butyrate, stannous octoate, stannous oxalate, stannous benzoate, and stannous cyclohexanecarboxylic; tin thiocarboxylates such as stannous thioacetate and stannous dithioacetate; dihydrocarbyltin bis (hydrocarbylmercaptoacetates) such as dibutyltin bis (isooctylmercaptoacetate) and dipropyltin bis(butyl mercaptoacetate); tin thiocarbonates such as stannous O-ethyl dithiocarbonate; tin carbonates such as stannous propyl carbonate; tetrahydrocarbyltin compounds such as tetrabutyltin, tetraoctyltin, tetradodecyltin, and tetraphenyltin; dihydrocarbyltin oxides such as dipropyltin oxide, dibuytltin oxide, butylstannonic acid, dioctyltin oxide, and diphenyltin oxide; dihydrocarbyltin bis(hydrocarbyl mercaptides) such as dibutyltin bis(dodecyl mercaptide); tin salts of phenolic compounds such as stannous thiophenoxide; tin sulfonates such as stannous benzenesulfonate and stannous p-toluenesulfonate; tin carbamates such as stannous diethylcarbamate; tin thiocarbamates such as stannous propylthiocarbamate and stannous diethylcarbamate; tin phosphites such as stannous diphenyl phosphite; tin phosphates such as stannous dipropyl phosphate; tin thiophosphates such as stannous O,O-dipropyl thiophosphate, stannous O,O-dipropyl dithiophosphate, and dihydrocarbyltin bis(O,O-dihydrocarbyl thiophosphates) such as dibutyltin bis(O,O-dipropyldithiophosphate).

Of the above mentioned attenuating agents which include tin, those which are organometallic and soluble in petroleum residua are preferred. Tin dialkyldicarboxylate is especially preferred. Attenuating agents including tin are preferred for use in residua which contain a promoting compound which includes molybdenum.

Examples of satisfactory bismuth-containing attenuating agents include bismuth metal, bismuth oxides, bismuth chlorides, bismuth nitrates, bismuth hydroxides, bismuth octoates, bismuth phosphates, bismuth sulfates, bismuth sulfides, bismuth selenides, bismuth naphthenates, bismuth oxalates, triethyl bismuth, triphenyl bismuth and trivinyl bismuth. Bismuth dithiocarbamate is especially preferred. Of the above mentioned attenuating agents which include bismuth, those which are organometallic and soluble in petroleum residua are preferred. Attenuating agents including bismuth are preferred for use in residua which contain a promoting compound which includes molybdenum.

Examples of satisfactory lead-containing attenuating agents include lead metal, lead oxides, lead chlorides, lead nitrates, lead hydroxides, lead octoates, lead phosphates, lead sulfates, lead sulfides, lead selenides, lead naphthenates, lead oxalates, triethyl lead, triphenyl lead and trivinyl lead. Lead dithiophosphate is especially preferred. Of the above mentioned attenuating agents which include lead, those which are organometallic and soluble in petroleum residua are preferred. Attenuating agents including lead are preferred for use in residua which contain a promoting compound which includes molybdenum.

Examples of calcium-containing attenuating agents include inorganic calcium compounds such as calcium oxides, calcium hydroxides, calcium sulfides, calcium carbonates, calcium phosphates, calcium sulfates, and calcium halides. Also included are organic calcium compounds such as calcium carboxylates, calcium dithiocarboxylates, calcium carbamates, calcium dithiocarbamates, calcium phosphites, calcium dithiophosphites, and calcium sulfonates. Additionally, compounds with a combination of organic and inorganic ligands may be used as attenuating agents, such as calcium carboxylate halides. Calcium sulfonate is especially preferred. Calcium is an excellent attenuating metal for suppressing coke yield increases caused by coke promoting compounds which include vanadium.

The present invention is not intended for use with a petroleum residuum feedstock containing metals which are present exclusively in their naturally occurring forms. For example, the two metals most commonly found in petroleum residua as a result of nature, nickel and vanadium, are often predominantly present as metal porphyrins, also termed petroporhyrins. The inventor has found that the naturally occurring forms of petroleum organometals, and metal porphyrins in particular, are relatively ineffective for increasing coke yield at thermal coking conditions. Also, the presence of the above described attenuating agents does not serve to make the metal porphyrins substantially more or less effective for increasing coke yield. Moreover, metal porphyrins are generally ineffective as attenuating agents.

In another preferred aspect, the invention comprises hydroprocessing a feedstock substantially composed of hydrocarbons in a hydroprocessing reaction zone which includes a hydrocracking catalyst containing a promoting metal, as described above, to produce a hydroprocessed residuum. At least a portion of the hydrocracking catalyst escapes from the hydrocracking reaction zone as a fugitive catalyst, passing from the hydrocracking reaction zone with the hydroprocessed residuum. The hydroprocessed residuum leaves the hydroprocessing reaction zone with about 100 to about 10,000 parts per million, preferably about 200 to about 5,000 parts per million, of the of the fugitive catalyst based on the total weight of the hydroprocessed residuum. It is believed, although not necessary for the success of this aspect, that the fugitive catalyst is in the form of a microparticulate dispersion of metal sulfides.

The fugitive catalyst and the hydrocessed residuum is blended with an attenuating agent, as described above. Preferably about 10 to about 1,000 parts per million, more preferably about 20 to about 500 parts per million, and most preferably about 50 to about 300 parts per million are artificially introduced to the blend, based on the total weight of the hydroprocessed residuum and the fugitive catalyst. The resulting treated residuum is subjected to thermal coking, as describe above, to produce coke and a distillate boiling range product. The distillate produce is recovered in a proportion greater than could be recovered without the attenuating agent.

The following Examples are presented to better communicate the invention, and are not intended to limit the scope of the invention in any way.

DESCRIPTION OF THE MICRO-PYROLYSIS TEST METHOD

In order to determine the coke yields of a range of heavy hydrocarbon feeds under delayed coking conditions, several procedures were performed, as described in the Examples below. Each of the procedures utilized a precise, yet relatively simple test method referred to herein as the micro-pyrolysis test method. The test method evaluates four formulations, in triplicate, per run which are typically employed as one control set and three distinct sample sets. Experience has shown that the test method can identify statistically significant coke yield differences which are as small as 0.1 weight percent.

Aliquots containing the material to be analyzed are weighed into twelve glass vials. The vials are positioned in a muffle furnace under a nitrogen purge. The muffle furnace is ramped by a programmable temperature controller at a reproducible rate from room temperature to a peak temperature. Thereafter, the muffle furnace is maintained at the peak temperature for one hour, and the muffle furnace is cooled to room temperature. At room temperature, the vials are weighed again. The weight percent of coke produced in the muffle furnace is calculated under the assumptions that the nitrogen purge removes all non-volatile material from the vials, and that all of the material remaining in the vials is coke.

In the Examples set forth below, the effect of additive metals on coking is expressed in weight percent as an "incremental coke yield." For each twelve vial run of the test method, an average of coke yields exhibited by control samples of that run for heavy hydrocarbon containing no additive metals is calculated and defined to be the control coke yield for that run. The incremental coke yield is calculated for a sample set in the run by calculating an average coke yield for the sample set and then subtracting the control coke yield defined for that run.

EXAMPLE 1

A procedure was performed which demonstrates the effect of molybdenum content on coke yield under delayed coking conditions for a petroleum residuum. The residuum was obtained from a crude petroleum by means of vacuum distillation. Results of chemical analyses for the residuum, which is herein referred to as Residuum A, are reported in Table I above. It is noted that Residuum A originally contained essentially no molybdenum, although certain molybdenum compounds were added to Residuum A during the course of the procedure.

Control samples were prepared which contained only Residuum A. Sample sets were also prepared which contained Residuum A and known amounts of a molybdenum compound, which was a molybdenum dithiophosphate or molybdenum disulfide. The source of molybdenum disulfide was a toluene insoluble material recovered from a hydrocracking reactor into which a molybdenum dithiophosphate had been introduced as a catalyst. The micro-pyrolysis test method described above was employed with the control sets ands the sample sets. Calculated incremental coke yields are shown as a function of molybdenum content in FIG. 1, where the molybdenum content is expressed as the weight in parts per million of added molybdenum metal based on the total weight of Residuum A and molybdenum compound.

Referring now to FIG. 1, it can be seen that throughout the range of about 1 to about 1000 parts per million, and more by extrapolation, increased molybdenum content correlates with an increased incremental coke yield for Residuum A under thermal coking conditions. For example, 1000 ppm of molybdenum produced an increase in incremental coke yield of about 4.8 weight percent. Moreover, the increase in incremental coke yield per unit of molybdenum appears to be particularly great in the range of about 1 to about 100 parts per million of molybdenum.

Molybdenum introduced as a molybdenum dithiosphosphate and molybdenum introduced as molybdenum disulfide both appear to be effective in increasing incremental coke yield. On the basis of the data depicted in FIG. 1, it can be reasonably concluded that dispersed molybdenum disulfide particles promote coke yield in petroleum residua under thermal coking conditions.

EXAMPLE 2

This Example documents the efficacy of certain metals for attenuating the increase in incremental coke yield correlated with molybdenum content in a petroleum residuum under delayed coking conditions. Control samples consisted of Residuum A, as described in Example 1 above. Sample sets were prepared for a promoted residuum, which was Residuum A to which 200 ppm of molybdenum had been added in the form of a molybdenum dithiophosphate. Other sample sets were prepared which contained the promoted residuum and, additionally, a known amount of an attenuating metal introduced in the form of an attenuating agent. Antimony was introduced in the form of antimony dithiocarbamate or antimony dithiophosphate. Lead, tin and bismuth were introduced in the form of dithiocarbamate, dialkyldicarboxylate and dithiocarbamate, respectively.

The micro-pyrolysis test method described above was employed with the control sets and the sample sets. Calculated incremental coke yields are shown as a function of attenuating metal content in FIG. 2, where the attenuating metal content is expressed as the weight in parts per million of added attenuating metal, based on the total weight of the promoted residuum and the attenuating agent. Significantly, the incremental coke yields for the promoted residuum ranged from 1.1 to 1.3 weight percent greater than the control samples, which contained only residuum A.

Figure 2:
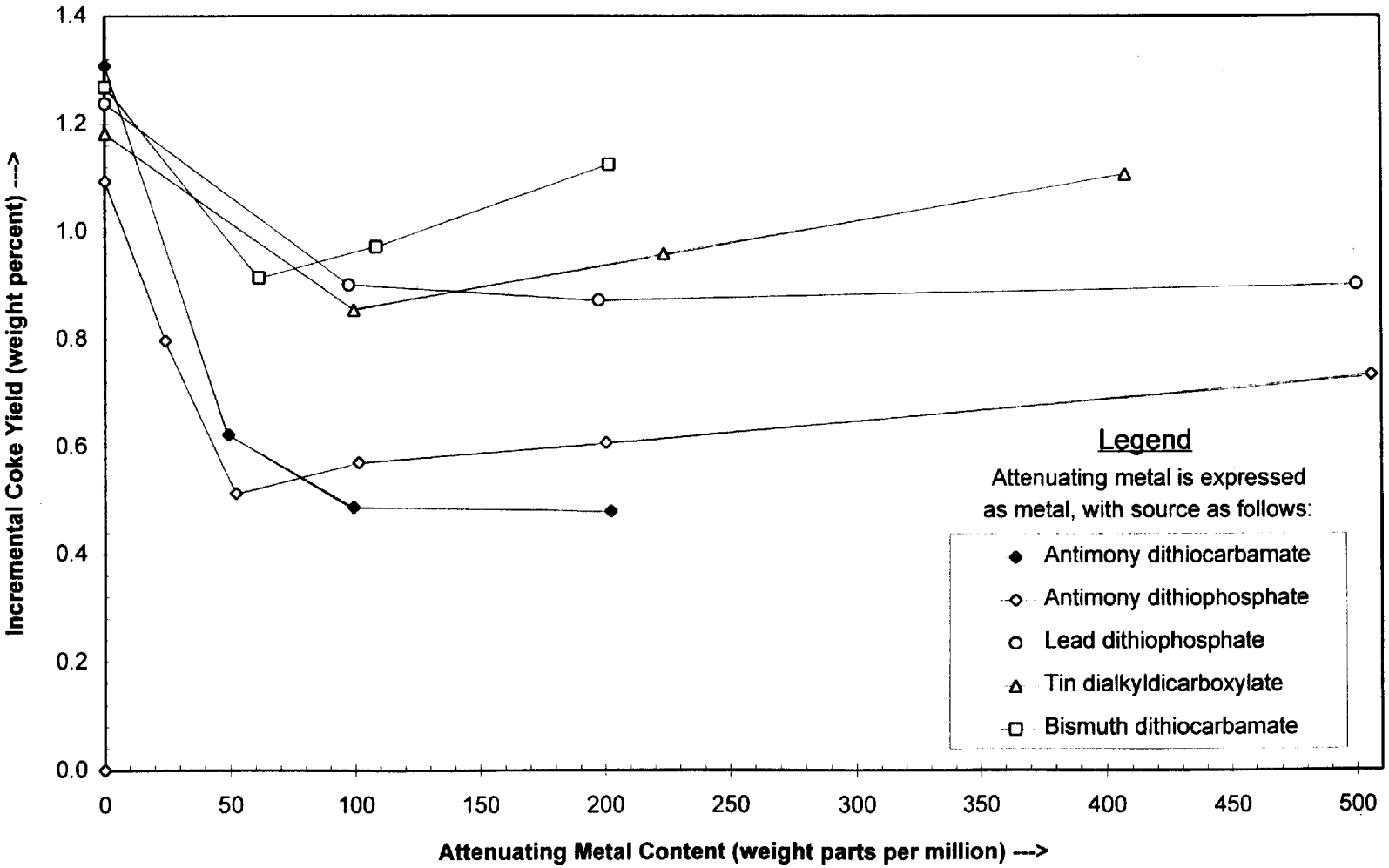
FIG. 2 is a graph illustrating that the increase in incremental coke yield observed for residuum containing molybdenum is mitigated by addition of certain attenuating metals up to a peak effectiveness value.

Referring now to FIG. 2, it can be seen that throughout the range of about 1 to about 500 parts per million, and more by extrapolation, the presence of antimony, lead, tin or bismuth correlates with a decreased incremental coke yield for the promoted residuum exposed to delayed coking conditions, as compared to the incremental coke yield observed for the promoted residuum with no added attenuating metals. On the basis of the data depicted in FIG. 2, it can be reasonably concluded that the presence of antimony, lead, tin or bismuth attenuate the promoting effect on coke yield which is associated with the presence of molybdenum in petroleum residua under thermal coking conditions.

Moreover, the data shown in FIG. 2 is evidence of an anomaly. In the range of about 10 to about 300 parts per million, an anomaly exists wherein increasing concentrations of the attenuating metals produce greater decreases in incremental coke yield up to a peak effectiveness concentration. At concentrations greater than the peak effectiveness concentration, which appears to have a slightly different value for each of the attenuating metals tested, further increases in concentration have comparatively little effect or result in relatively increased incremental coke yield.

EXAMPLE 3

Vanadium and nickel were also investigated as potential promoters for increasing coke yield of a residuum under delayed coking conditions. For this investigation, a relatively high sulfur residuum was obtained from crude petroleum by means of vacuum distillation. Results of chemical analyses for the high sulfur residuum, which is herein referred to as Residuum B, are reported in Table I above.

Control samples were prepared which contained only Residuum B. Sample sets were also prepared which contained Residuum B and known amounts of added vanadium or added nickel. The added metals were introduced as vanadium naphthenate and nickel 2-ethylhexanoate, respectively. The micro-pyrolysis test method described above was employed with the control sets ands the sample sets. Calculated incremental coke yields are shown as functions of vanadium content and nickel content in FIG. 3, where the promoting metal content is expressed as the weight in parts per million of added promoting metal based on the total weight of Residuum B and vanadium naphthenate or nickel 2-ethylhexanoate.

Figure 3:
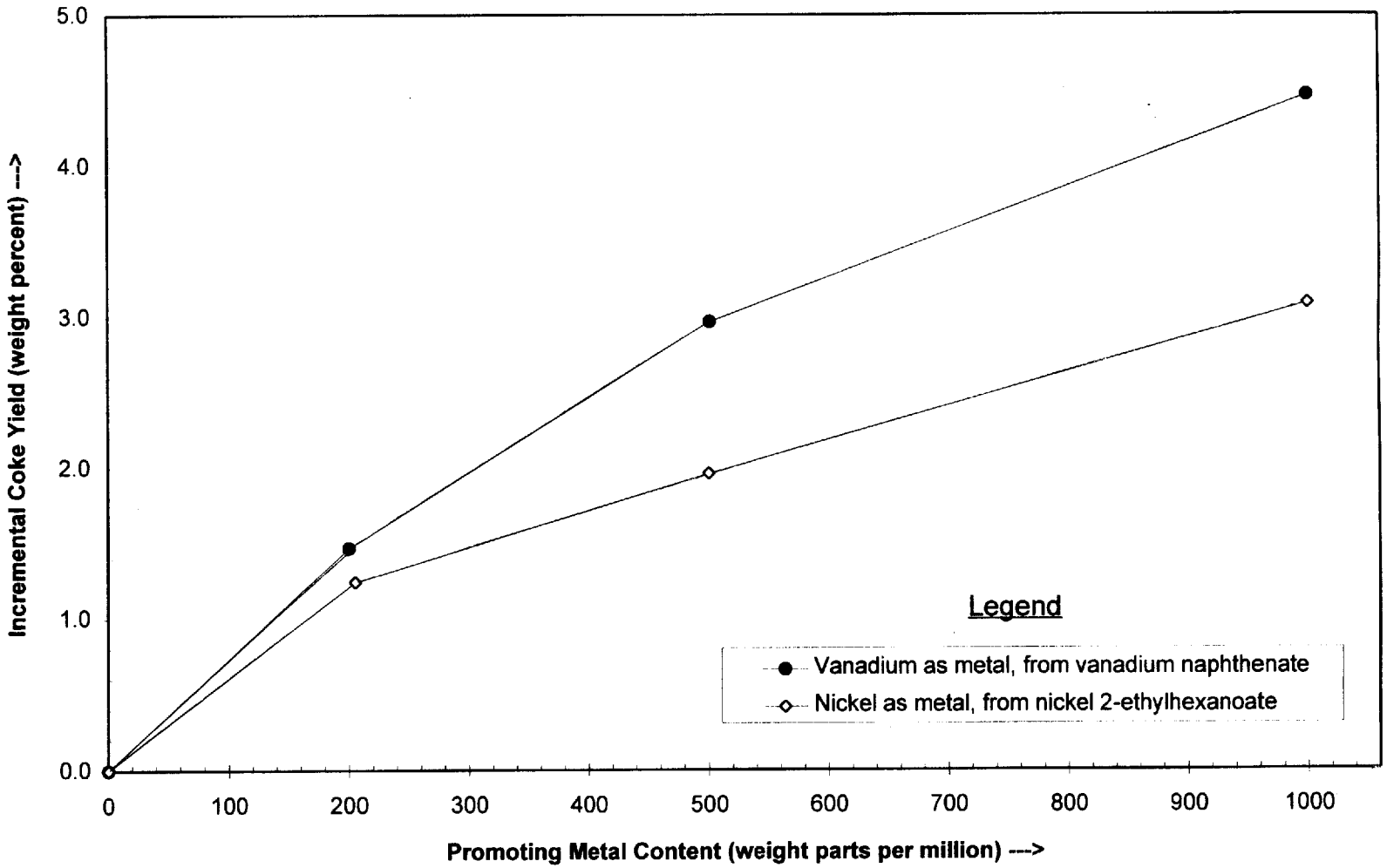
FIG. 3 is a graph which portrays the incremental coke yields for petroleum residua containing vanadium or, alternatively, nickel, as monotonically increasing functions of vanadium or nickel content in the residuum.

Referring now to FIG. 3, it can be seen that throughout the range of about 1 to about 1000 parts per million, and probably more, increased vanadium or nickel content correlates with an increased incremental coke yield for Residuum B under thermal coking conditions. Specifically, 1000 ppm of vanadium from vanadium naphthenate produced an increase in incremental coke yield of 4.6 weight percent. A nickel content of 1000 ppm from nickel 2-ethylhexanoate produced an increase in incremental coke yield of 3.1 weight percent. On the basis of the data depicted in FIG. 1, it can be reasonably concluded that dispersed vanadium sulfide and nickel sulfide particles promote coke yield in petroleum residua under thermal coking conditions.

It is noted that while Residuum B originally contained essentially no molybdenum, Residuum B did contain measurable amounts of naturally occurring vanadium and nickel. However, the use of Residuum B as control sample and the method defined above for calculating incremental coke yield are believed to minimize the effect of the naturally occurring vanadium and nickel on experimental results. Additionally, the naturally occurring vanadium and nickel in petroleum residuum is usually present in the form of vanadium porphyrin and nickel porphyrin. Previous experiments indicated that the porphyrin forms of vanadium and nickel are relatively ineffective as coke yield promoters for a petroleum residuum under delayed coking conditions.

EXAMPLE 4

This Example demonstrates that certain metals attenuate the increase in incremental coke yield correlated with vanadium content or, alternatively, nickel content in a petroleum residuum under delayed coking conditions. Control samples consisted of Residuum B, as described in Example 3 above. Sample sets were prepared for a promoted residuum, which was Residuum B to which 500 ppm of vanadium or, alternatively, nickel had been added in the form of vanadium naphthenate or nickel 2-ethylhexanoate, respectively. Other sample sets were prepared which contained the promoted residuum and, additionally, a known amount of an attenuating metal added in the form of an attenuating agent. To attenuate the coke yield promoting effects of added vanadium, calcium was introduced in the form of calcium sulfonate. To attenuate the coke yield promoting effects of added nickel, antimony was introduced in the form of antimony dithiocarbamate or antimony dithiophosphate.

Figure 4:
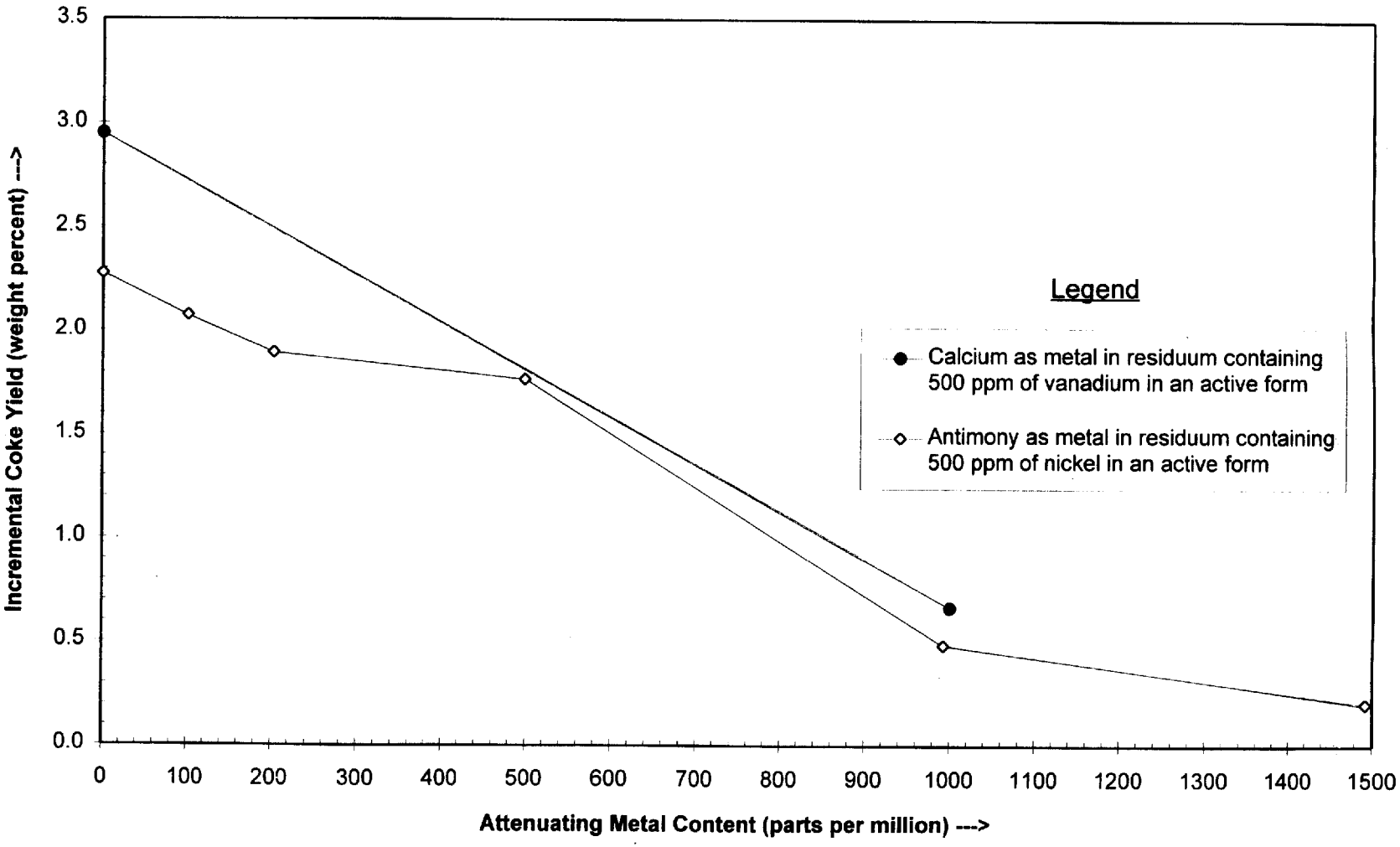
FIG. 4 is a graph which shows that the increase in incremental coke yield observed for residua containing vanadium or, alternatively, nickel is alleviated by addition of calcium or antimony, respectively.

The micro-pyrolysis test method described above was employed with the control sets ands the sample sets. Calculated incremental coke yields are shown as a function of attenuating metal content in FIG. 4, where the attenuating metal content is expressed as the weight in parts per million of added attenuating metal, based on the total weight of the promoted residuum and the attenuating agent. On the basis of the data depicted in FIG. 4, it can be reasonably concluded that the presence of calcium attenuates the promoting effect on coke yield which is associated with the presence of vanadium in petroleum residua under thermal coking conditions. Moreover, the data shown in FIG. 4 indicates that antimony can attenuate the incremental coke yield increase associated with petroleum residua containing added nickel under thermal coking conditions.

EXAMPLE 5

A hydrocracked petroleum residuum having a sulfur content of 1.85 weight percent, a vanadium content of 100 weight ppm, a nickel content of 53 weight ppm, and a hydrogen to carbon molar ratio of 1.25 is employed as control sample in tests utilizing the micro-pyrolysis test method described above. Sample sets are prepared and tested which contain known amounts of molybdenum, vanadium, nickel, cobalt and copper. Incremental coke yields are calculated which demonstrate that each of molybdenum, vanadium, nickel, cobalt and copper is an effective promoting metal for increasing incremental coke yield in a hydrocracked petroleum residuum under thermal coking conditions.

Additionally, sample sets are prepared which contain the hydrocracked residuum; a known amount of molybdenum, vanadium, nickel, cobalt or copper; and an attenuating agent which includes an attenuating metal. Results of tests employing the micro-pyrolysis test procedure, which is described above, indicate that the coke yield promoting effect of molybdenum on the hydrocracked residuum is attenuated by antimony from antimony dithiocarbamate or antimony dithiophosphate, lead from lead from lead dithiocarbamate, tin from tin dialkyldicarboxylate, and bismuth from bismuth dithiocarbamate. The results also indicate that the promoting effect of vanadium is attenuated by calcium from calcium sulfonate, and that the promoting effects of nickel, cobalt, and copper are attenuated by antimony from antimony dithiocarbamate or antimony dithiophosphate.

For the purposes of the present invention, "predominantly" is defined as more often than not. In quantitative terms, predominantly denotes about fifty per cent or more. "Substantially" is defined as being present in such proportions or occurring with sufficient frequency so as to measurably affect macroscopic qualities of an associated compound or system. Where the proportion or frequency required for measurable impact is not clear, substantially is to be regarded as twenty percent or more. "Essentially" is defined as absolutely except that small variations which have no more than a negligible effect on macroscopic qualities and final outcome.

Practitioners who study the teachings set forth herein will undoubtedly receive suggestions which bring to mind many additional aspects of the invention. Such obviously similar aspects, whether or not expressly described herein, are intended to be within the scope of the present claims.

I claim as my invention:

1. A method for controlling thermal coking in a petroleum residuum containing a coke promoting compound, which comprises:

blending a petroleum residuum containing a coke promoting compound with an attenuating agent to produce a treated residuum, wherein the attenuating agent is present in the treated residuum as dispersed solid particles and, wherein the coke promoting compound is not a porphyrin and includes molybdenum, and wherein the attenuating agent includes an attenuating metal selected from the group consisting of antimony, lead, tin, bismuth or a mixture thereof;

thermal coking the treated residuum at reaction conditions including a hydrogen partial pressure of about 0.01 to about 2 atmospheres, a temperature in the range of about 400 to about 500 degrees C., and a residence time of about one to about forty hours to produce coke and a distillate boiling range product; and recovering the distillate product in a measurable proportion, based on the weight of the petroleum residuum blended, which is significantly greater than the proportion recoverable without blending the petroleum residuum with the attenuating agent.

2. The method of claim 1 wherein about 10 to about 1,000 parts per million by weight of the attenuating agent is blended with the petroleum residuum, based on the weight of the petroleum residuum.

3. The method of claim 1 wherein the attenuating agent is dissolved in the treated residuum, and precipitates under the thermal coking reaction conditions to form a particulate dispersion.

4. The method of claim 1 wherein the petroleum residuum is substantially composed of hydrocarbon molecules having a collective hydrogen to carbon molar ratio of about 0.8 to about 1.6.

5. The method of claim 1 wherein the petroleum residuum contains about 0.1 to about 10 weight percent sulfur.

6. The method of claim 1, wherein the concentration of molybdenum in the petroleum residuum is about 20 to less than about 10,000 parts per million by weight.

7. A method for producing a distillate boiling range product, which comprises:

hydroprocessing a feedstock substantially composed of hydrocarbons in a hydroprocessing reaction zone which includes a hydrocracking catalyst containing a promoting metal selected from the group consisting of molybdenum, nickel, cobalt, or copper or a mixture thereof to produce a hydroprocessed residuum, wherein at least a portion of the hydrocracking catalyst becomes a fugitive catalyst which passes from the hydroprocessing reaction zone with the hydroprocessed residuum;

blending the hydroprocessed residuum and the fugitive catalyst with an attenuating agent which includes an attenuating metal selected from the group consisting of antimony, lead, tin, bismuth or a mixture thereof to produce a treated residuum, wherein the attenuating agent is present in the treated residuum as dispersed solid particles, and;

thermal coking the treated residuum at reaction conditions including a hydrogen partial pressure of about 0.01 to about 2 atmospheres, a temperature in the range of about 400 to about 500 degrees C., and a residence time of about one to about forty hours to produce coke and a distillate boiling range product; and recovering the distillate product in a measurable proportion, based on the total weight of the hydroprocessed residuum and the fugitive catalyst, which is greater than the proportion recoverable without blending the hydroprocessed residuum and the fugitive catalyst with the attenuating agent.

8. The method of claim 7 wherein the hydrocracking catalyst includes molybdenum and the attenuating agent includes antimony, tin, lead, bismuth or a mixture thereof.

9. The method of claim 7 wherein the hydrocracking catalyst includes nickel and the attenuating agent includes antimony.

10. The method of claim 7 wherein the hydrocracking catalyst included in the hydroprocessing reaction zone is ebullated or dispersed during normal operation.

11. The method of claim 7 wherein about 10 to about 1,000 parts per million by weight of the attenuating agent is blended with the hydroprocessed residuum and the fugitive catalyst, based on the total weight of the hydroprocessed residuum and the fugitive catalyst.

12. The method of claim 7 wherein the hydroprocessed residuum contains about 100 to about 10,000 parts per million of the fugitive catalyst by weight, based on the total weight of the hydroprocessed residuum and the fugitive catalyst.

13. A method for controlling thermal coking in a petroleum residuum containing a coke promoting compound, which comprises:

blending a petroleum residuum containing a coke promoting compound with an attenuating agent to produce a treated residuum, wherein the coke promoting compound is in the form of a dispersed particulate and includes a sulfide of molybdenum and the attenuating agent is selected from the group consisting of antimony dithiocarbamate, antimony dithiophosphate, lead dithiocarbamate, tin dialkyldicarboxylate, bismuth dithiocarbamate or a mixture thereof;

thermal coking the treated residuum at conditions including a hydrogen partial pressure of about 0.01 to about 2 atmospheres, a temperature in the range of about 400 to about 500 degrees C., and a reaction time of about one to about forty hours to produce coke and a distillate boiling range product; and recovering the distillate product in a measurable proportion, based on the amount of the petroleum residuum blended, which is greater than the proportion recoverable without blending the petroleum residuum with the attenuating agent.

14. The method of claim 13 wherein the coke promoting compound is molybdenum disulfide.

* * * * *